United States Patent [19]

Fox et al.

[11] Patent Number: 4,648,414

[45] Date of Patent: Mar. 10, 1987

[54] BENDABLE LIGHTWEIGHT ARTICLE FOR PERSONAL GROOMING AND METHOD OF MAKING

[75] Inventors: Steve A. Fox, Hickory, N.C.; Donald L. Murray, Gloucester; Frederick Dinkin, Cambridge, both of Mass.

[73] Assignee: Cel Co., Inc., Cambridge, Mass.

[21] Appl. No.: 641,718

[22] Filed: Aug. 16, 1984

[51] Int. Cl.[4] ..... A45D 2/18

[52] U.S. Cl. ..... 132/43 R; 132/39

[58] Field of Search ..... 132/43, 40, 89, 42; 604/1; 128/269

[56] References Cited

U.S. PATENT DOCUMENTS

| | | | |
|---|---|---|---|
| 1,552,618 | 9/1925 | Klemm, Jr. | 132/43 R |
| 1,619,743 | 3/1927 | McClaire | 132/43 R |
| 1,917,341 | 7/1933 | Thau | 132/43 R |
| 2,061,817 | 11/1936 | Van Cleef | 132/43 R |
| 2,074,816 | 3/1937 | Trotter | 132/43 R |
| 2,392,024 | 1/1946 | Couri | 446/374 |
| 2,542,601 | 2/1951 | Van Cleef | 132/43 R |
| 2,757,676 | 8/1956 | Hamilton | 132/42 R |
| 2,838,054 | 6/1958 | Fischer | 132/43 R |
| 3,228,398 | 1/1966 | Leonard et al. | 604/1 |
| 3,837,351 | 9/1974 | Thurnton | 132/89 |
| 4,041,961 | 8/1977 | Shaler | 132/40 |

FOREIGN PATENT DOCUMENTS 2111382 7/1983 United Kingdom .

*Primary Examiner*—Gregory E. McNeill

*Attorney, Agent, or Firm*—Bell, Seltzer, Park & Gibson

[57] ABSTRACT

An elongate lightweight and readily bendable rod-like article and method of making, wherein the article is adapted to be used for a variety of purposes such as a hair curling rod or wrist bracelet. The article comprises a low density and continuous foam body of closed cell foam, a pliable metallic core extending throughout the length of the body and serving to resiliently maintain the body in any desired bent configuration, adhesive surrounding the metallic core throughout the length thereof and bonding the metallic core to the body so that the body and metallic core are unitized and bend together, the adhesive also serving as a corrosion resistant protective coating on the metallic core, and end caps sealing opposite ends of the body and providing a protective shield for opposite ends of the metallic core.

13 Claims, 8 Drawing Figures

BENDABLE LIGHTWEIGHT ARTICLE FOR PERSONAL GROOMING AND METHOD OF MAKING

This invention relates to lightweight and readily bendable rod-like foam articles that may be bent to any desired configuration so as to be used for a variety of purposes such as for personal grooming, for example. In this regard the articles may be of any desired length to be used as a hair curling rod, hair holder for a ponytail, novelty wrist bracelet, etc. Other uses unrelated to personal grooming may readily come to mind for use of articles of this invention.

The articles of this invention particularly lend themselves for use as hair curling rods in personal grooming for a variety of reasons. Foremost is that the articles may be readily bent into a wide variety of configurations to accommodate the random arrangement of forming curls on one's head.

The articles of this invention are constructed not only for comfort of the user but also for safe use. The comfort of the article, as when one reclines with their hair in curlers, is assured by the low density foam material forming the body of the curlers not irritating one's scalp by "digging in". The safety of the articles of the invention when used is enhanced by the protective softness of the overall foam body and by protective end caps on the body being so constructed as to completely cover opposite ends of the body and the metallic core extending therethrough so as to provide a protective shield for the ends of the metallic core, as well as to seal off opposite ends of the body.

Further, the articles of this invention are formed of closed cell foam with the foam having a liquid impervious skin-like outer surface to resist and prevent absorption of liquids such as hair permanent solutions into the body which otherwise would shorten the life of the foam body and create a "build up" problem on the foam body of deleterious solutions injurious to one's hair.

To aid in handling the articles of this invention, the skin-like outer surface of the foam body is pebbled to increase the frictional resistance of the surface for thereby facilitating manual handling of the article and for enhanced gripping of hair or the like wound on or engaged by the article.

To prolong the bendable life of the article and to avoid rupture and protrusion of the metallic core, which is preferably formed of copper wire, an adhesive in the form of a coating is provided on the wire to bond the wire and foam body into a unitized structure. Thusly unitized, the wire is prevented from being bent sharply upon itself to virtually eliminate any likelihood of rupturing the wire from repeated bendings of the articles.

Further, the unitizing of the wire core and body by the adhesive coating completely avoids any problem of the foam body "skinning back" along the wire. This assures that the foam will always protectively surround the wire. This relationship together with the adhesive coating itself serves to provide corrosion resistant protection to the wire. This corrosion resistant protection is further assured by opposite ends of the foam and wire being protected by sealing end caps desirably formed of thermoplastic material bonded to the opposite ends of the foam body and the wire core.

While various types of foam articles are well known in the prior art for personal grooming, it is believed to be novel to provide foam articles having the various combinations of features as heretofore mentioned.

It is therefore a primary object of this invention to provide a greatly improved bendable lightweight article of the type described which is comfortable and safe when in use, and is easy to grip and handle, and which is so constructed that the foam body and metallic core are unitized by an adhesive bond therebetween for further safety and increased useful life of the article.

It is a more specific object of this invention to provide elongate lightweight and readily bendable rod-like articles of various lengths adapted to be used for a variety of purposes such as a hair curling rod or wrist bracelet in personal grooming, for example, and wherein the article is formed of an elongate, low density, and continuous foam body of closed cell foam with a pliable metallic core extending throughout the length of the body and serving to resiliently maintain the body in any desired bent configuration. Adhesive means surround the metallic core throughout its length and bond the metallic core to the foam body so that the body and metallic core are unitized and bend together, with the adhesive also serving as a corrosion resistant protective coating on the metallic core. End caps are connected to opposite ends of the body and completely cover the ends of the body and the metallic core to seal the same and to prevent liquid from coming into contact with the ends of the body and metallic core and also to provide a protective shield for opposite ends of the metallic core.

It is another object of this invention to provide a method for making articles of the type described. Such method includes advancing a bendable metallic strand from a supply source through an extrusion die at a first extrusion station while continuously extruding and applying an adhesive coating in surrounding relation to the metallic strand passing therethrough, advancing the thus coated metallic strand through an extrusion die at a second extrusion station while extruding and forming a low density closed cell foam body bonded to the metallic strand by the adhesive coating, severing the thus formed product into rod-like articles of predetermined lengths, and apply a sealant to opposite ends of the rod-like articles so as to completely cover and seal the opposite ends of the articles.

Some of the features and advantages of the invention having been stated, others will appear from the detailed description which follows, when taken in connection with the accompanying drawings, in which FIG. 1 is a perspective view of a completed article of the invention;

FIG. 2 is an enlarged fragmentary perspective view of an end portion of the article, partly in section;

FIGS. 3, 4, and 5 show various environmental uses of the articles of this invention, FIG. 3 showing the articles used as hair curling rods, FIG. 4 showing the article used as a novelty wrist bracelet and FIG. 5 showing the article used as a holder for a ponytail;

Figure 1:
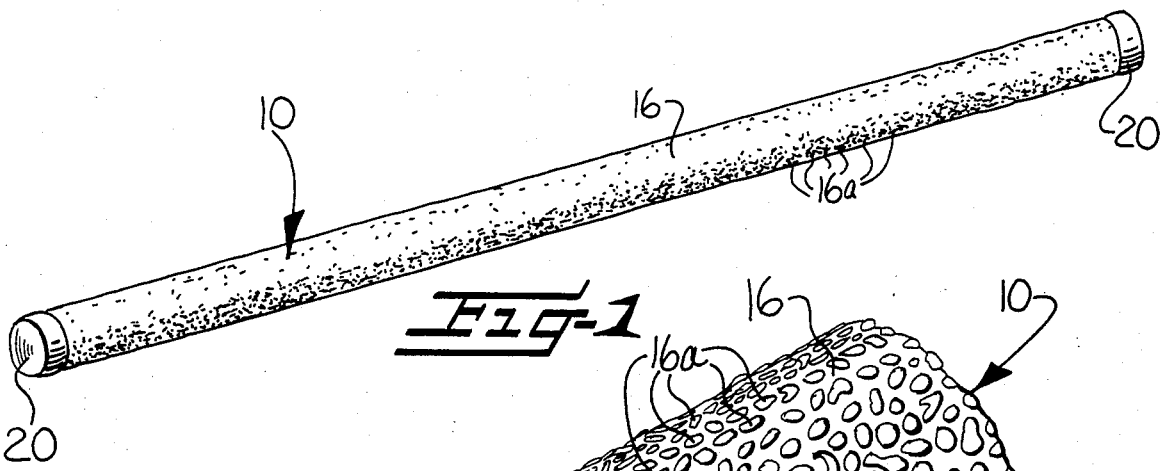
Figure 2:
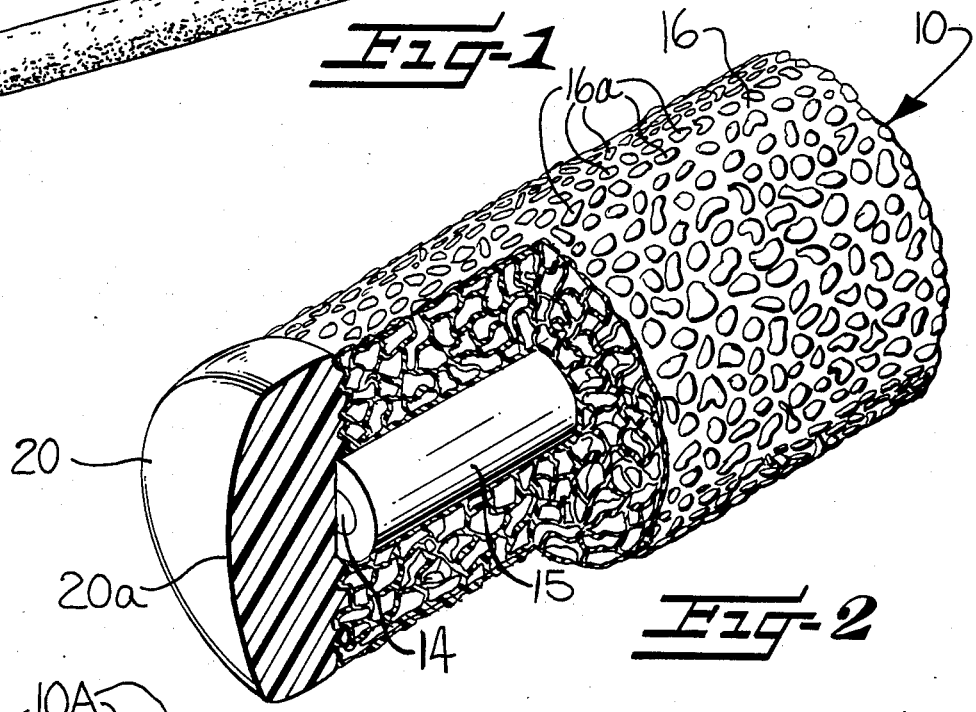
Figure 6:
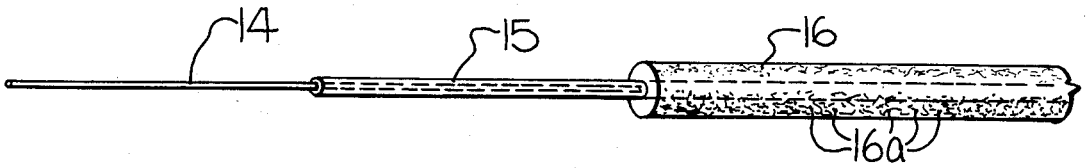
FIG. 6 is another perspective view of the article similar to FIG. 1 with parts broken away to illustrate the internal construction.

Referring now specifically to the drawings, and particularly to FIGS. 1, 2 and 6, reference numeral 10 broadly indicates one of the elongate lightweight and readily bendable rod-like articles of this invention.

These rod-like articles 10 may be of any suitable cross section and length. When cylindrical in cross section, about ¼" to about 1" diameter has proven to be an acceptable range of sizes. The rod-like articles 10 comprise a readily bendable metallic core 14, preferably formed of copper wire, with an adhesive coating 15 bonded thereto and serving for bonding a surrounding foam body 16 to the core 14.

The body 16 is formed of low density closed cell foam, with the body extending continuously throughout the length of the wire core 14 and completely surrounding the same. Desirably, the foam body has a specific gravity of about 0.05 to 0.15 grams/cc, and preferably a specific gravity of about 0.10 to 0.15 grams/cc. One of many conventional and suitable resins for forming the closed cell foam is a polyethylene resin, for example, having a melt index of 2.0 and a density of 0.92 grams/cc. As is conventional, based on weight, 5% freon #12 as a blowing agent, 1% talc as a nucleator, and ½ oz. color pigment are added to the polyethylene resin to provide the desired color and other characteristics to the foam.

The low density of the foam creates such buoyancy to the article as to render the article floatable. Also, the low density of the foam not only serves for providing a soft exterior to the article but also serves for enhanced memory of the bent position of the article so as to accommodate the article to a wide variety of configurations. The foam body 16 preferably is formed with a liquid impervious skin-like outer surface through extrusion formation of the foam body. This skin-like surface serves to resist and prevent absorption of liquids, such as hair permanent solution, into the body 16 which otherwise would shorten the life of the foam body and create a "build up" problem on the body of deleterious solutions injurious to one's hair. The skin-like outer surface of the foam body 16 is preferably provided with a pebbled surface **16*a*** by virtue of coalescing of collapsed foam bubbles on the foam body surface during extrusion of the foam body. This pebbled surface serves to increase the frictional resistance of the outer surface of the foam body for facilitating manual handling of the article and for enhancing the gripping of hair or the like wound on or engaged by the article.

The adhesive 15 is desirably formed of a coating thickness of about 0.004 to 0.050 inch. An adhesive thickness of about one-half the wire diameter, e.g., 0.031 inch has been found commercially acceptable, with a wire diameter of 0.062 inch. As noted earlier, the adhesive coating 15 not only serves for bonding the metallic core 14 to the foam body 16 but also serves as a corrosion resistant protective coating on the metallic core 14. A suitable type of adhesive for effecting bonding to both the foam body and the metallic core is an ethylene acrylic acid copolymer (EAA) manufactured by Dow Chemical Co. under their product number Dow EAA 455.

The metallic core 14, as noted earlier, is preferably formed of copper wire since copper wire is readily bendable. Desirably the wire is formed of a diameter of about 0.040 to 0.150 inch. A wire diameter that has been found commercially acceptable is 0.062 inch.

Covering opposite ends of the foam body 16 as well as opposite ends of the metallic core 14 are solid plastic end caps 20 which desirably are formed of a conventional hot melt thermoplastic, such as amorphous polypropylene, for example, so as to be applied hot so as to bondingly engage opposite ends of the foam body 16 as well as opposite ends of the metallic core 14. As illustrated in FIG. 2, the end caps 20 are desirably formed with a crowned outer configuration so that central portions **20*a* of the end caps 20 are of greater thickness so as to provide more protection overlying opposite ends of the metallic core 14. Thus, the end caps 20, by being bonded to the foam body and metallic core, serve for providing a sealed relation to the opposite ends of the rod-like article 10**. The end caps may be formed of the same color hue as the foam body which body is preferably brillantly colored. However the end caps may be formed of a contrasting hue for enhanced aesthetics of the article, as when used as a wrist bracelet.

Figure 3:
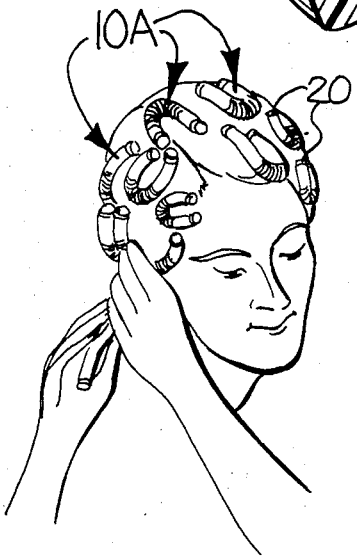
Figure 4:
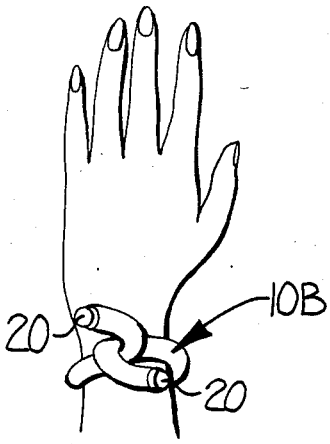
Figure 5:
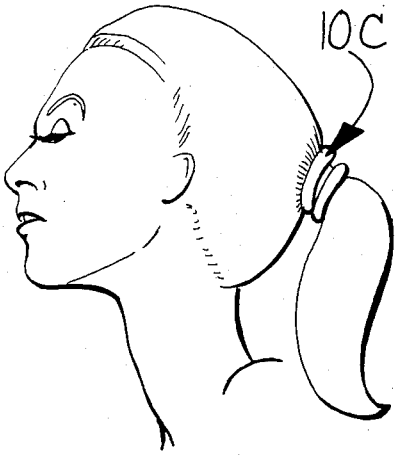

The lengths of the articles 10 of this invention may vary considerably depending upon the type of end use for the article. As illustrated in FIG. 3 wherein articles 10A are shown being utilized for hair curling rods, typically the length of such articles is six to eight inches. However for use of the articles for novelty wrist bracelets, such as illustrated in FIG. 4 by reference numeral 10B, such articles would typically be somewhat longer than those for use as hair curling rods. Referring now to FIG. 5 wherein the article 10C is shown for use as a hair holder for a ponytail, typically the article for this use would be somewhat longer than the article 10A and many times would be of a length between the length of the article 10A and that of article 10B.

Figure 7:
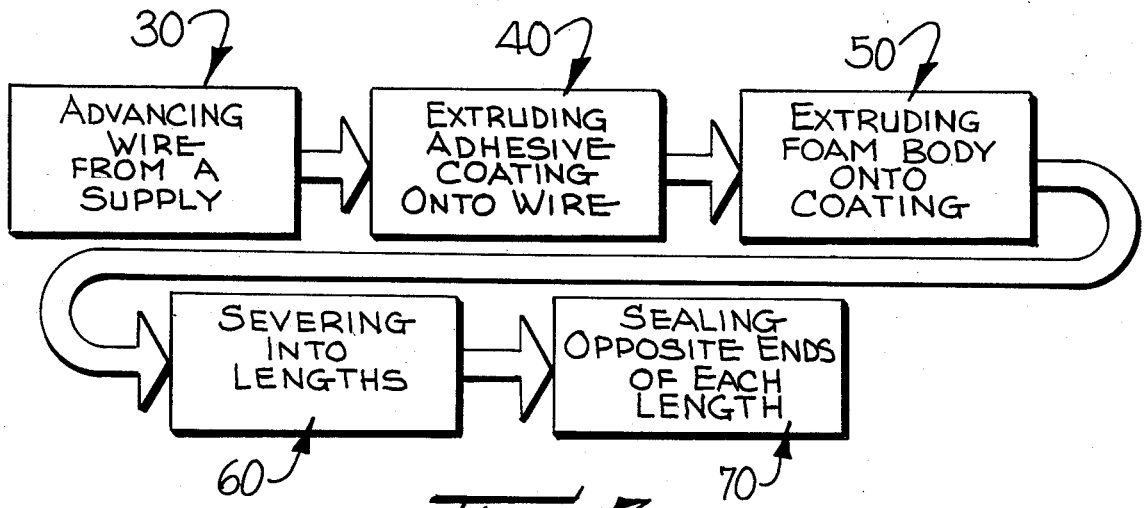
FIG. 7 is a block diagram illustrating the steps of the process for making the articles of this invention.
Figure 8:
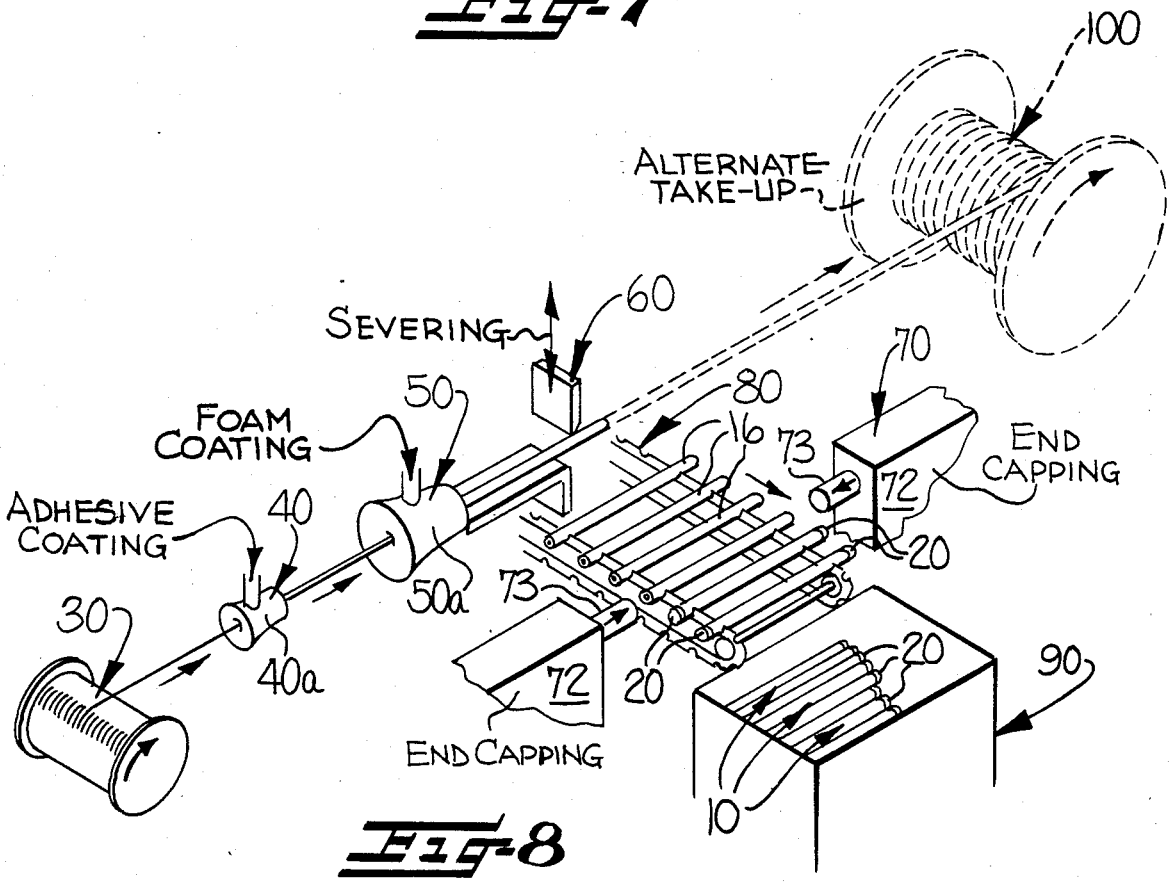
FIG. 8 schematically illustrates the arrangement of apparatus for making the articles of this invention.

Referring now to the process for making the articles of this invention with particular reference to FIGS. 7 and 8 illustrating such process, reference numeral 30 indicates a reel or supply source of wire material for forming the metallic core 14. As illustrated, the wire is successively advanced through a first extrusion station 40 and a second extrusion station 50 with the first station including a suitable extrusion die **40*a* (FIG. 8) for continuously extruding and applying a suitable adhesive coating to the wire for effecting bonding of the wire to the subsequent foam coating being extruded through a suitable die 50*a* (FIG. 8) at the second extrusion station 50 for continuously forming the foam body 16 of the article, which foam body thus surrounds the length of wire 14 with its adhesive means 15** thereon.

Reference numeral 60 indicates a suitable cutting or severing device for effecting severing of the product being formed into predetermined lengths. Reference numeral 70 identifies a third station and apparatus for forming the end caps on the articles. FIG. 8 illustrates the formation of such end caps by providing an opposing pair of end capping devices 72 at the end cap forming station 70, wherein the end capping devices 72 have suitable hot melt nozzles or applicators 73 carried thereby, and which nozzles 73 serve for applying hot thermoplastic into engagement with opposite ends of the severed articles for thus applying thermoplastic hot melt end caps 20 on opposite ends of each cut length of the articles. For facilitating movement of the severed lengths of articles from the severing or cutting station 60 to the end cap forming station 70, a suitable conveyor 80 may be provided for successively receiving the cut lengths from the cutting station 60 and moving the same to a position between the opposing pairs of end capping devices 72 of the end cap forming station 70. Following forming of the end caps 20 on the articles, the articles are suitably conveyed forwardly by the conveyor 80 into a hopper broadly indicated at 90.

Still referring to FIG. 8 in particular, instead of the severing of the articles taking place continuously with the formation of the article, in certain instances it might be desirable to wind the product onto a storage reel or drum 100 and thereafter, in a separate operation, effecting the cutting of the product to the desired lengths and the applying of the end caps 20 to opposite ends thereof.

It will thus be apparent that there has been disclosed a uniquely constructed bendable lightweight article for a variety of purposes including personal grooming. Also there has been disclosed a method of making such product which method lends itself for high production rates of operation.

In the drawings and specification there have been set forth preferred embodiments of the invention, and although specific terms are employed, they are used in a generic and descriptive sense only, and not for purposes of limitation.

That which is claimed is:

1. An elongate lightweight and readily bendable rod-like article adapted to be used for a variety of purpose such as a hair curling rod or wrist bracelet, said article comprising an elongate, low density, and continuous foam body formed entirely of closed cell foam, a pliable metallic core extending throughout the lenth of said body and serving to resiliently maintain the body in any desired bent configuration, said foam body and said metallic core being of coextensive length, adhesive means surrounding said metallic core throughout the length thereof and bonding said metallic core to said body so that the body and metallic core are unitized and bend together, said adhesive means serving as a corrosion resistant protective coating on said metallic core, and end caps sealably connected to opposite ends of said body and completely covering the ends of the body and said metallic core to seal the same and to prevent liquid from coming into contact with the ends of the body and metallic more and also to provide a protective shield for opposite ends of said metallic core.

2. An article according to claim 1 wherein said body has a liquid impervious skin-like pebbled outer surface to increase the frictional resistance of the surface for facilitating manual handling of the article and for enhancing gripping of hair or the like wound on the article.

3. An article according to claim 1 or 2 wherein said end caps are formed of thermoplastic material bonded to opposite ends of said body and said metallic core.

4. An article according to claim 3 wherein said metallic core is substantially centrally disposed in said body and wherein said end caps are crowned with the thickness in at least the central portions of the end caps being many times greater than the thickness of said metallic core to thereby provide a relatively thick protective shield overlying the ends of the metallic core.

5. An article according to claim 1 wherein said foam body is formed of polyethylene and has a specific gravity within the range of about 0.05 to 0.15 grams/cc, so the body is of such lightweight construction that the overall article is floatable.

6. An article according to claim 1 wherein said metallic core is copper wire and has a diameter within the range of about 0.040 to 0.150 inch.

7. An article according to claim 1 wherein said foam body is cylindrically shaped in cross-section and has a diameter within the range of about ¼ inch to about one inch, and wherein the thickness of said metallic core is within the range of about 0.040 to 0.150 inch, and wherein the thickness of said adhesive coating is within the range of about 0.004 to 0.050 inch.

8. An article according to claim 1 wherein said foam body is formed of a brilliantly colored foam and said end caps are formed of a solid plastic of the same color hue as said body to visually minimize one noticing thar the end caps are formed separately from the body.

9. An article according to claim 1 wherein said foam body is formed of a brilliantly colored foam and said end caps are formed of a solid plastic of a color contrasting thereto to enhance the aesthetic effect of the article when used as a wrist bracelet or the like.

10. An elongate lightweight and readily bendable rod-like article adapted to be used for a variety of purposes such as a hair curling rod or wrist bracelet, said article comprising an elongate, low density, and continuous foam body formed entirely of closed cell foam, said foam body having a specific gravity within be range of about 0.05 to 0.15 grams/cc, said body also having a liquid impervious skin-like outer surface, a pliable metallic core extending throughout the length of said body and serving to resiliently maintain the body in any desired bent configuration, said foam body and said metallic core being of coextensive length, adhesive means surrounding said metallic core throughout the length thereof and bonding said metallic core to said foam body so that the body and metallic core are unitized and bend together, said adhesive means serving as a corrosion resistant protective coating on said metallic core, and thermoplastic end caps formed of solid non-foamed plastic sealably bonded to opposite ends of said body and completely covering the ends of the body and said metallic core to seal the same and to prevent liquid from coming into contact with the ens of the body and metallic core and also to provide a protective shield for opposite ends of said metallic core.

11. An article according to claim 10 wherein the metallic core is a cylindrical wire and the thickness of said adhesive coating on the wire is about one half the diameter of the wire.

12. A lightweight and readily bendable article adapted to be formed into predetermined lengths so as to be used for variety of purposes such as a hair curling rod or wrist bracelet, said article comprising an elongate, low density, and continuous foam body formed entirely of closed cell foam, a pliable metallic core extending throughout the length of said body and serving to resiliently maintain the body in any desired bent configuration, said foam body and said metallic core being of coextensive length, and adhesive means surrounding said metallic core throughout the length thereof and bonding said metallic core to said foam body so that the body and metallic core are unitized and bend together, said adhesive means serving as a corrosion resistant protective coating on said metallic core.

13. A light weight and readily bendable article adapted to be formed into predetermined lengths so as to be used for a variety of purposes such as a hair curling rod or wrist bracelet, said article comprising an elongate, low density, and continuous foam body formed entirely of closed cell foam having a specific gravity within the range of about 0.05 to 0.15 grams/cc, said body having a liquid impervious skin-like outer surface, a pliable metallic core of copper wire extending throughout the length of said body and serving to resiliently maintain the body in any desired bent configuration, said foam body and said metallic core being of coextensive length, and adhesive means surrounding said metallic core throughout the length thereof and bonding said metallic core to said foam body so that the body and metallic core are unitized and bend together, said adhesive means serving as a corrosion resistant protective coating on said wire core.

* * * * *